US006146162A

United States Patent [19]

Okabe

[11] Patent Number: 6,146,162

[45] Date of Patent: Nov. 14, 2000

[54] LEVER FITTING CONNECTOR

[75] Inventor: Toshiaki Okabe, Shizuoka, Japan

[73] Assignee: Yazaki Corporation, Tokyo, Japan

[21] Appl. No.: 09/109,934

[22] Filed: Jul. 2, 1998

[30] Foreign Application Priority Data

Jul. 2, 1997 [JP] Japan ..... 9-177101

[51] Int. Cl.[7] ..... H01R 13/62

[52] U.S. Cl. ..... 439/157; 439/372

[58] Field of Search ..... 439/157, 372, 439/680

[56] References Cited

U.S. PATENT DOCUMENTS

| | | | |
|---|---|---|---|
| 5,104,330 | 4/1992 | Yagi et al. | 439/157 |
| 5,330,362 | 7/1994 | Ito et al. | 439/157 |
| 5,344,194 | 9/1994 | Hatagishi et al. | 439/26 |
| 5,435,738 | 7/1995 | Isohata | 439/157 |
| 5,595,492 | 1/1997 | Taguchi | 439/157 |

FOREIGN PATENT DOCUMENTS

| | | | |
|---|---|---|---|
| 5-182716 | 7/1993 | Japan | H01R 13/629 |
| 6-68933 | 3/1994 | Japan | H01R 13/629 |
| 6-251826 | 9/1994 | Japan | H01R 13/629 |
| 6-302353 | 10/1994 | Japan | H01R 13/629 |

*Primary Examiner*—Paula Bradley
*Assistant Examiner*—Katrina Davis
*Attorney, Agent, or Firm*—Sughrue, Mion, Zinn, Macpeak & Seas, PLLC

[57] ABSTRACT

Protrusion portions at the top end of a lever 26 attached rotatably to a connector body 24 of a male connector 25 are locked in lock holes 28 on a hood portion 22 side through guide long holes 39*c* of insertion guide ribs 38*b* formed on the both sides of the connector body 24, and the insertion guide ribs 39*b* are inserted and fitted into connector guide grooves 27*a* formed in the hood portion 22. Consequently, the insertion guide ribs have both a function to prevent the lever from shaking in any direction but the direction of rotation, and an insertion guide function to guide the connector body. It is therefore possible to make the connector as a whole small in size.

2 Claims, 5 Drawing Sheets

LEVER FITTING CONNECTOR

BACKGROUND OF THE INVENTION

1. Field of Invention

The present invention relates to a lever fitting connector for fitting female and male connectors to each other by operating a lever.

2. Related Art

FIG. 6 shows a frame-connection-type connector 1 disclosed in Japanese Patent Unexamined Publication No. Hei-6-251826. This connector 1 is constituted by a female connector portion 3 provided in a body 2 of a connection box such as an electric connection box or the like, a male connector 5 to be inserted and fitted into a hood portion 4 of this female connector portion 3, and a frame 6 for inserting and fitting the male connector into the female connector portion 3. A plurality of electric wires (not shown) are attached to the male connector 5, and led out from the rear end side of this male connector 5. In addition, the frame 6 is constituted by a body 7 which receives the male connector 5 inside rotatably, a rotation foot portion 8 provided so as to project from one side of the body 7, and an operation convex portion 9 provided so as to project from the other side. A sliding shaft 10 is formed on a top end portion of the rotation foot portion 8. This sliding shaft 10 is inserted and locked into a slide groove 12 of a frame support portion 11 provided around the female connector portion After the sliding shaft 10 is locked in the slide groove 12, the operation convex portion 9 is pushed to rotate the frame 6 in the direction of the arrow a around the sliding shaft 10. As a result, the male connector 5 is inserted and fitted into the female connector portion 3. On the other hand, to pull out the male connector 5 fitted to the female connector portion 3, the operation convex portion 9 is pushed in the opposite direction to thereby rotate the frame 6 in the direction opposite to the arrow a so that the male connector 5 can be drawn out from the hood portion 4 of the female connector portion 3.

In this case, the sliding shaft 10 acts as a fulcrum, and the operation convex portion 9 acts as a point where force is applied so that the portion of the male connector 5 which is rotatably supported by the frame 6 becomes a point of application and the male connector 5 can be fitted into the female connector portion 3 as shown in FIG. 6 with a small force. It is therefore possible to reduce an operation force when the male connector 5 and the female connector portion 3 are fitted to each other.

In the above-mentioned frame-connection-type connector 1, however, the frame support portion 11 in which the rotation foot portion 8 of the frame 6 is locked require a wide occupation space in the outside of the female connector portion 3 as shown in FIGS. 6 and 7. Accordingly, the miniaturization of the frame connecting 25 connector as a whole is hindered.

There is another defect that the body 7 armoring the male connector 5 is bent sideways at the time of operation, and therefore the portion supporting the male connector rotatably is apt to be detached.

Further, since there is provided no guide means for guiding the male connector 5 into the hood portion 4 of the female connector portion 3, there is a further problem that the male connector 5 may injure a wiring terminal portion in the connector if the fitting surface of the male connector 5 pushes the frame 6 in a state where the fitting surface is inclined.

SUMMARY OF THE INVENTION

It is therefore an object of the present invention to provide a lever fitting connector in which lever operation can be carried out surely without making the size large, which can realize and without breaking a terminal portion.

According to the first aspect of the present invention, a lever fitting connector includes: a female connector portion having a hood portion receiving terminals; a male connector portion body portion receiving partner terminals to be connected to the first-mentioned terminals and being fitted to the hood portion; and a lever rotatably attached to the male connector for inserting and fitting the connector body into the hood portion; provided in that a protrusion portion for locking with the hood portion is formed on one side of the lever, an operation portion for performing rotation operating is formed on the other side of the lever, an insertion guide rib to be inserted into a connector guide groove formed in the hood portion is formed in the connector body, and a long hole to which the protrusion portion is inserted so that the protrusion portion can be locked in the hood portion is formed in the guide rib.

In this lever fitting connector, the insertion guide rib formed in the connector body is inserted and fitted into the connector guide groove formed in the hood portion. Accordingly, it is possible to fit the connector body to the hood portion surely without tilting the connecting body. In addition, the protrusion portion of the lever locked in the hood portion is inserted into the long hole of the insertion guide rib formed in the connector body. Accordingly it is possible to prevent the lever from shaking in any direction other than the rotation direction. Further, the insertion guide rib (including the long hole) has both an insertion guide function to guide the connector body and a rotation guide function to guide the lever. Accordingly it is possible to minimize the size of the connector.

According to a second aspect of the present invention, the lever has two lever walls which are rotatably and slidably in contact with on opposite side walls of the connector body, the protrusion portion being formed on one side of each of the lever walls, the operation portion connecting the lever walls being formed on the other side, the lever walls being sandwiched between the side walls of the connector body and the inner wall of the hood portion in a condition that the connector body is fitted into the hood portion.

In this lever-fitting-type connector, the lever walls are sandwiched between the side walls of the connector body and the inner wall of the hood portion in the state where the connector body is fitted to the hood portion. Accordingly, the lever walls can be prevented by the inner wall of the hood portion from being bent outside, and the lever walls can be prevented from being detached from the support portions of the side walls of the connector body.

BRIEF DESCRIPTION OF THE DRAWINGS

FIG. 4(*b*) a side view of the same;

FIG. 4(*c*) is a front view of the same;

DETAILED DESCRIPTION OF THE PREFERRED EMBODIMENTS

Figure 1:
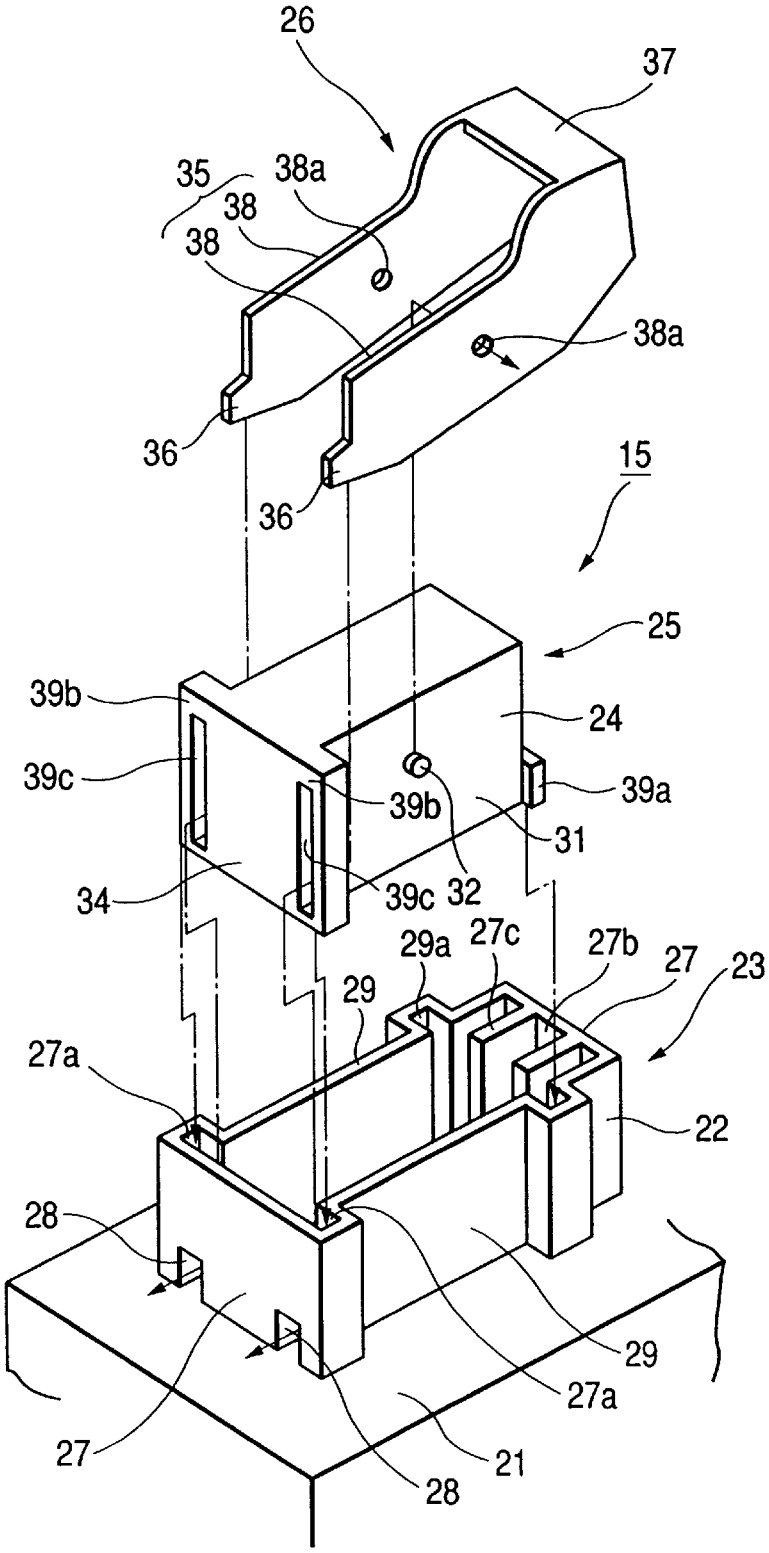
FIG. 1 is an exploded perspective view illustrating a carrying-out mode of a connector according to the present invention.

The details of a lever-fitting-type connector according to the present invention will be described on the basis of a carrying-out mode illustrated in the drawings.

Description will be made about a lever-fitting-type connector (hereinafter simply referred to as "connector") 15 in this carrying-out mode shown in FIGS. 1 to 4. This connector 15 is used in an upper cover 17 of an electric connection box 16 shown in FIG. 2 so as to connect bus bars 20 on wiring boards 19 stacked between the upper cover 17 and a lower cover 18 to terminal portions of a wire harness. As shown in FIG. 1, the connector 15 is constituted by a female connector portion 23 in which a hood portion 22 is formed integrally with a housing portion 21 of the upper cover 17, a male connector 25 having a connector body 24 to be inserted and fitted into the hood portion 22 of the female connector portion 23, and a lever 26 armoring the connector body 24 of the male connector 25 for inserting and fitting the connector body 24 into the hood portion 22 of the female connector portion 23.

Figure 2:
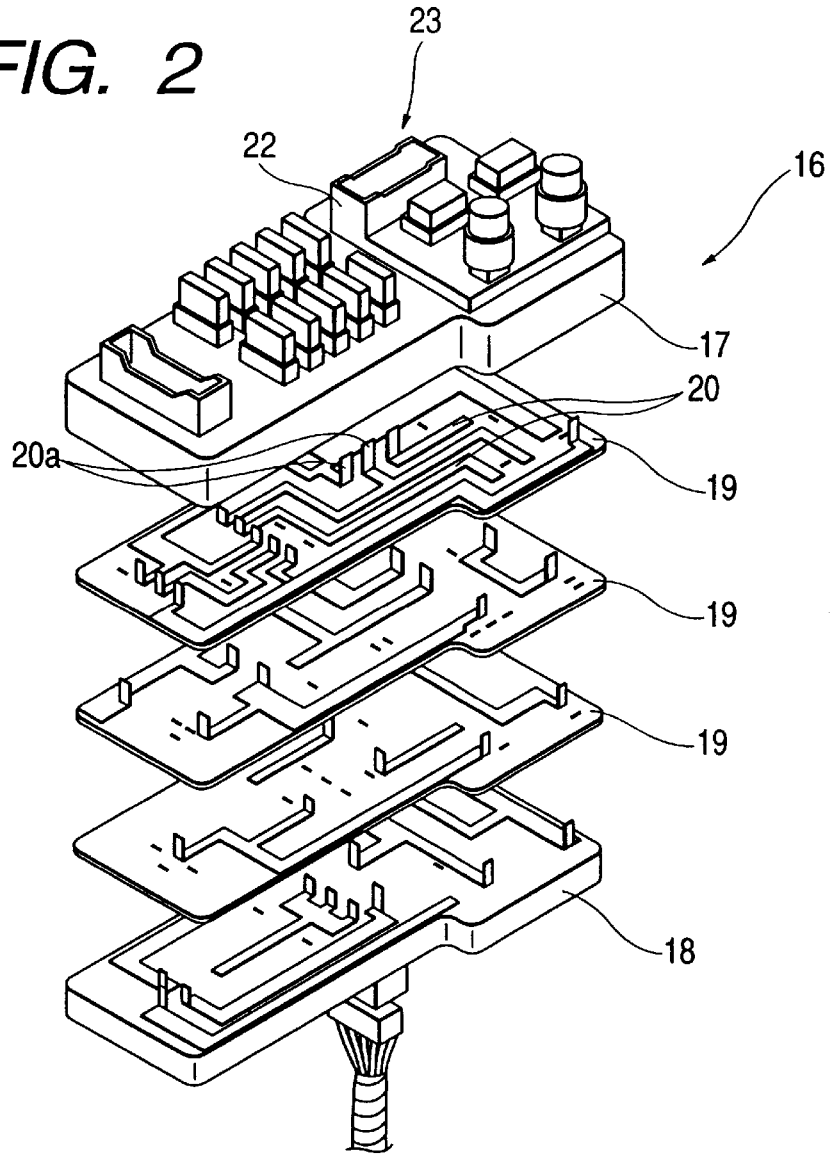
FIG. 2 is an exploded perspective view illustrating a structure on the female connector side in this carrying-out mode.

In the female connector portion 23, as shown in FIG. 2, the terminal portions of the above-mentioned bus bars 20 are received in the housing portion 21, and male terminal portions 20*a* of the terminal portions are provided so as to project into the inside of the hood portion 22. In the hood portion 22, as shown in FIG. 1, notch portions 28 and 28 are formed in a wall portion 27 so as to make the inside communicate with the outside. In addition, in opposite side portions of this one-side wall portion 27, connector guide grooves 27*a* and 27*a* are formed so as to extend in the fitting direction of the connector body 24 to thereby guide insertion guide ribs 39*b* and 39*b* which are formed so as to project sideways in the opposite side portions of one side of the connector body 24. The insertion guide ribs will be described later. A wall portion of the hood portion 22 around this connector guide grooves 27*a* is formed so as to project to the opposite sides. A lock hole 27*b* is formed in the other-side wall portion 27 of the hood portion 22, so that a lock protrusion 26*b* of a lock member 26*a* formed integrally with the lever 26 which will be described later is inserted into the lock hole 27*b* so as to be locked therein. In addition, guide grooves 29*a* and 29*a* for guiding the guide ribs 39*a* provided on the opposite sides of the lower portion of the other-side wall 34 of the connector body 24 which will be described later are formed so as to extend, in the fitting direction of the connector body 24, in the inner wall surfaces of a pair of opposite wall portions 29 and 29 constituting the hood portion 22 together with the above-mentioned wall portions 27 and 27. Further, two ribs 27*c* and 27*c* are formed on the inner wall surface of the other-side wall portion 27 of the hood portion 22 so as to extend in parallel with each other in the fitting direction. The connector body 24 of the male connector 25 is inserted into the hood portion 22 arranged thus, so that female terminals (not shown) received in the connector body 24 are made to be in electric contact with the male terminal portions 20*a*.

In the male connector 25, a plurality of terminal reception chambers (not shown) are provided inside the connector body 24, and female terminals (not shown) are received in these terminal reception chambers individually. Partner terminals 20*a* are inserted from the lower side of the terminal reception chambers in the drawing, and electric wires (not shown) with terminals to which the female terminals are connected are led out from the upper side in the drawing. In addition, columnar boss portions 32 are provided so as to project in the center portions in the opposite side walls 31 and 31 (only one of the side walls being illustrated in FIG. 1) of the connector body 24. The length of the boss portions 32 is set so that the boss portions 32 can be received inside rotation holes 39*a* formed in lever walls 38 which will be described later.

Further, insertion guide ribs 39*b* are formed on the opposite sides of one of the side walls 34 of the connector body 24 so as to extend in the fitting direction. Those insertion guide ribs 39*b* are inserted and fitted into the respective connector guide grooves 27*a* and 27*a* formed in the hood portion 22. In those insertion guide ribs 39*b* and 39*b*, long guide holes 39*c* are formed so as to extend in the fitting direction. In addition, the connector body 24 is armored by the lever 26.

Figure 3:
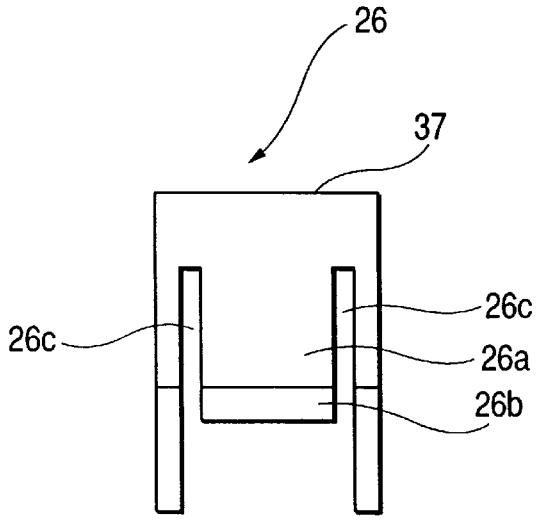
FIG. 3 is a front view illustrating the other side portion of a lever in this carrying-out mode.

The lever 26 is constituted by a lever body 35, protrusion portions 36 and 36 and an operation portion 37. The lever body 35 is supported rotatably on the connector body 24 of the male connector 25 and constituted by a pair of lever walls 38 and 38 opposite to each other. The protrusion portions 36 and 36 are provided on one side of the lever body 35 so as to be locked in the notch portions 28 and 28 of the hood portion 22 when the protrusion portions are inserted into the long guide holes 39*c* and 39*c* in the case where the connector body 24 is fitted into the hood portion 22. The operation portion 37 is provided on the other side of the lever body 35 so as to rotate the lever body 35 around the lock portion where the protrusion portions 36 are locked on the hood portion 22 to thereby fit the connector body 24 into the hood portion 22. The lever walls 38 and 38 are designed in such a shape that the other-side portions thereof are expanded upward. Further, at the centers of the lever walls 38, rotation holes 38*a* are formed so that the boss portions 32 formed in the connector body 24 are fitted rotatably thereto. In addition, on the other-side surface of the lever 26, as shown in FIG. 3, a lock member 26*a* is formed integrally with the operation portion 37 so as to hang down from the lower portion of the operation portion 37. A lock protrusion 26*b* to be locked in the above-mentioned lock hole 27*b* of the hood portion 22 is provided on the lower portion of the lock member 26*a* so as to project therefrom. In FIG. 3, the reference numerals 26*c* and 26*c* represent slits which are formed on the opposite sides of the lock member 26*a* so as to have a function to guide the lever 26 when the ribs 27*c* formed on the hood portion 22 are inserted into the slits 26*c* and 26*c* respectively in the case where the connector body 24 is fitted into the hood portion 22.

Figure 4A:
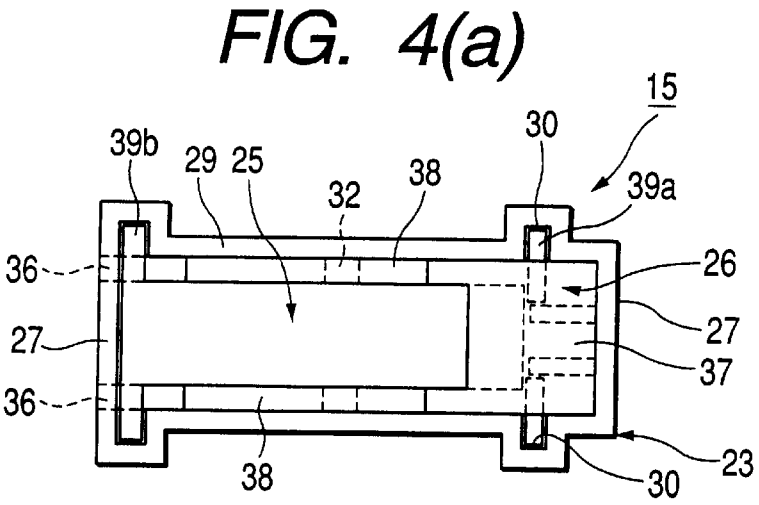
FIG. 4(*a*) is a plan view showing a state in which the connector in this carrying-out mode is fitted entirely.
Figure 4B:
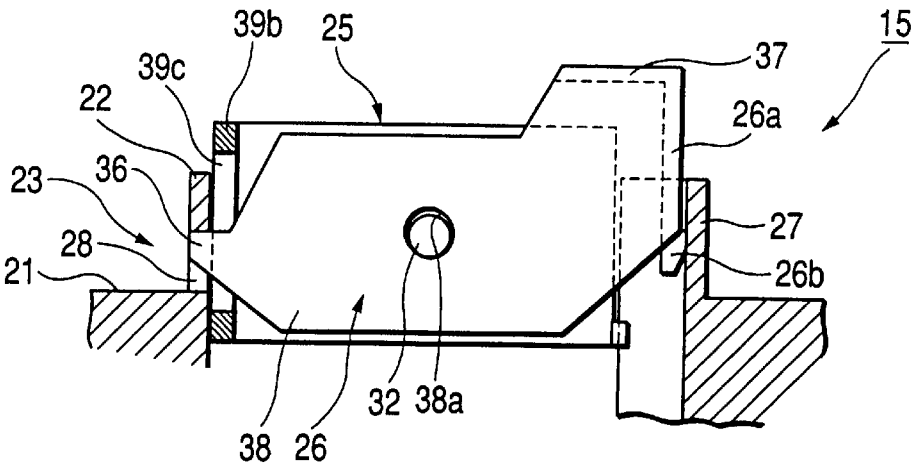
Figure 4C:
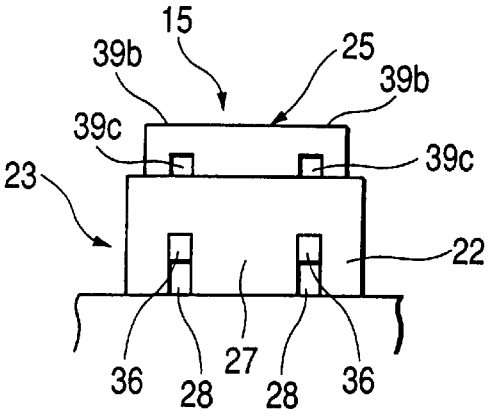

FIGS. 4(*a*), (*b*) and (*c*) show a state in which the male connector 25 has been fitted into the hood portion 22 of the female connector portion 23 entirely. In the lever 26, as shown in FIG. 4, the lever body 35 (the lever walls 38 and 38) and the lock member 26*a* are located inside the hood portion 22 in the state where the connector body 24 has been fitted into the hood portion 22. In addition, the lever walls 38 and 38 are interposed between the inner walls 29 and 29 of the hood portion 22 and the opposite side walls 31 and 31 of the connector body 24 as shown in FIG. 4(*a*), in the state where the connector body 24 has been entirely fitted in the hood portion 22. Accordingly, there is no fear that the lever 26 projects outside from the hood portion 22 of the female connector portion 23, so that the connector as a whole can be made small in size. In addition, since the lever body 35 is located inside the hood portion 22, the lever walls 38 are stopped by the inner wall portions of the hood portion 22 even if the lever walls 38 are bent toward the outside of the connector body 24. Accordingly, it is possible to prevent the lever body 35 from being detached from the connector body 24.

Next, in order to fit the male connector 25 to the female connector portion 23 in the connector in this carrying-out mode, an operation is performed such that the protrusion portions 36 inserted in the long guide holes 39*c* are put into the notch portions 28 of the hood portion in the state where the connector body 24 is armored by the lever 26. In this state the connector body 24 is fitted into the hood portion 22 on its way. That is, the insertion guide ribs 39*b* are inserted into the connector guide grooves 27*a*, and the guide ribs 39*a* are inserted into the guide grooves 29*a*. Since such a guide structure is disposed on each of one and the other sides of the hood portion 22, it is possible to fit the connector body 24 into the hood portion 22 smoothly without tilting the connector body 24 with respect to the fitting surface. When the operation portion 37 of the lever 26 is pushed then, the protrusion portions 36 are locked on the upper end surfaces of the notch portions 28 of the hood portion 22, and the lever 26 rotates around the lock portion as a fulcrum. With this rotation the connector body 24 is inserted and fitted into the hood portion 22 to reach an entirely fitted state as shown in FIG. 4(*b*). At the same time, the lock protrusion 26*b* at the lower end portion of the lock member 26*a* of the lever 26 is inserted and locked in the lock hole 27*b* of the hood portion 22. In order to taken out the connector body 24 from the hood portion 22, the operation portion 37 is lifted up in the state where the lock protrusion 26*b* is pushed in, and the operation portion 37 is rotated in the direction opposite to the direction of rotation at the time of fitting. Consequently, the lock member 26*a* is bent so that the lock member 26*a* can be rotated in the direction opposite to the direction of rotation at the time of fitting to thereby release the fitting.

In this carrying-out mode, the insertion guide ribs 39*b* for guiding the connector body 24 into the hood portion 22 acts to guide the lever 26 at the same time. Therefore, there is no fear that the structure becomes larger in size. In addition, with such a guide structure, there is no fear that the fitting surface of the connector of the connector body 24 is tilted. Accordingly, it is possible to perform fitting operation surely, and it is therefore possible to make a connector have high reliability without breaking wiring terminal portions inside the connector. Further, in this carrying-out mode, the ribs 27*c* are formed on the inner walls of the hood portion 22 so as to have a guide function for the lever 26. It is therefore possible to prevent the lever 26 from shaking to make it possible to perform operation more surely.

Figure 5:
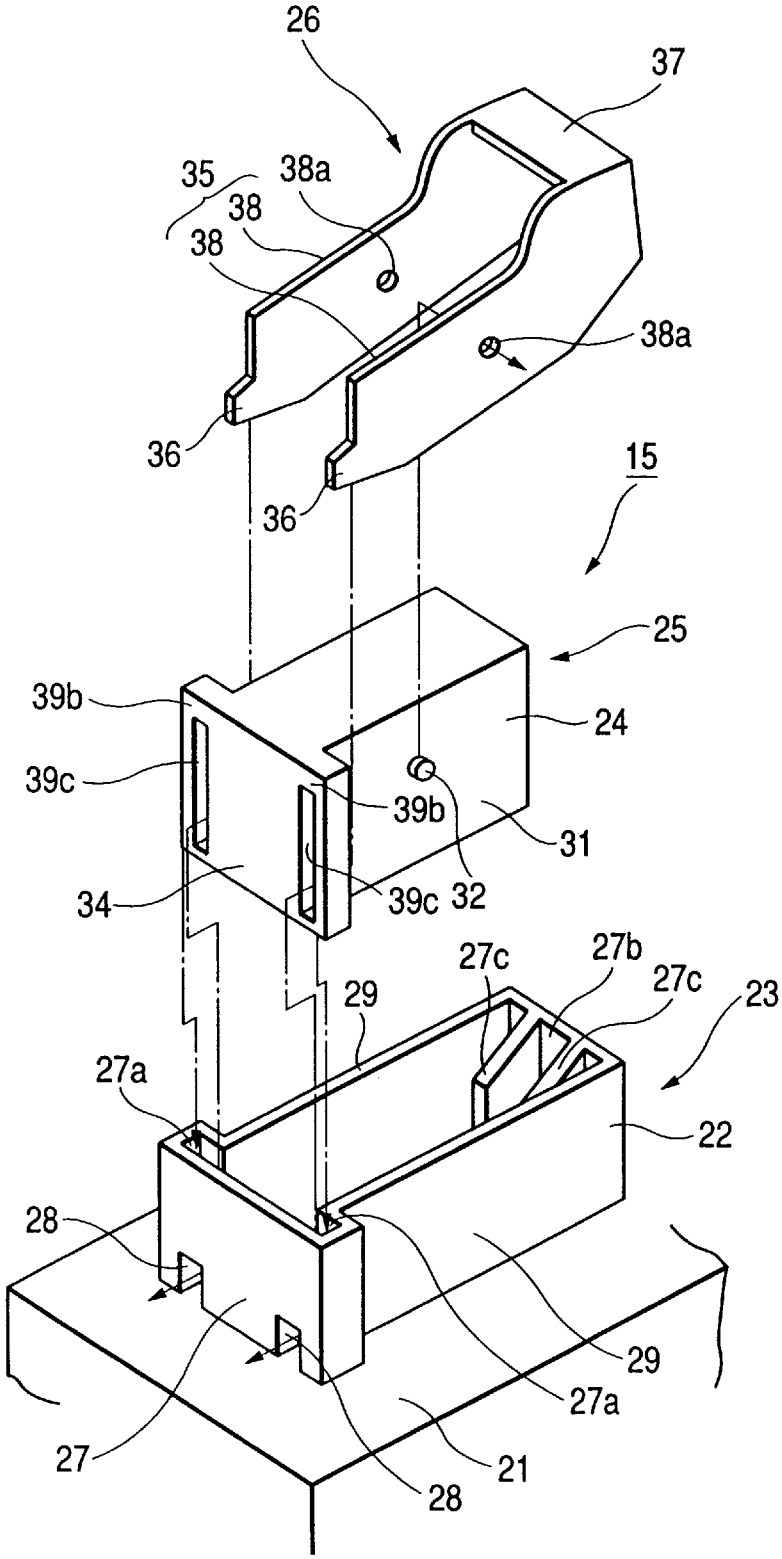
FIG. 5 is an exploded perspective view illustrating a modification of this carrying-out mode.
Figure 6:
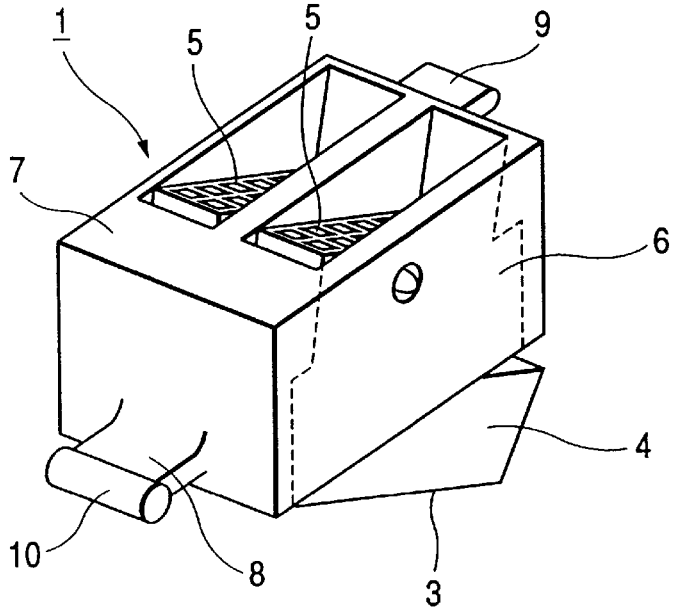
FIG. 6 PRIOR ART
FIG. 6 is a perspective view illustrating a conventional connector.
Figure 7:
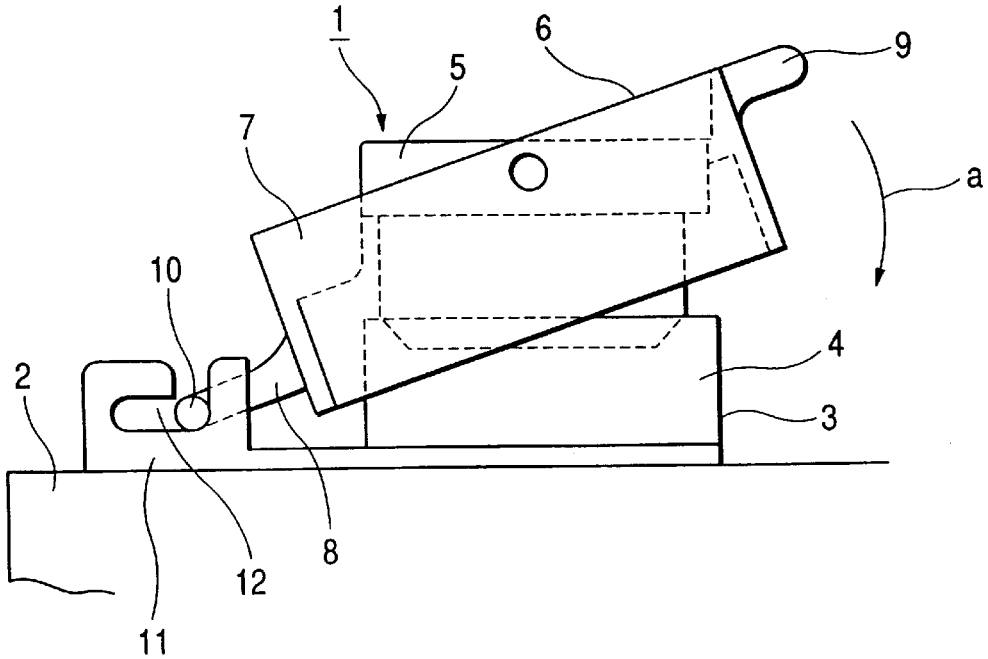
FIG. 7 PRIOR ART
FIG. 7 is a side view illustrating the conventional connector.

Next, a modification of this carrying-out mode will be described by use of FIG. 5. In the description of this modification, only different portions from those in the above-mentioned carrying-out mode will be described. In this example, differently from the above-mentioned carrying-out mode, no guide rib 39*a* is formed in the connector body 24. Accordingly, the hood portion 22 has no guide groove 29*a*. It is therefore possible, in this modification, to reduce the occupation scape of the connector 15. In addition, the upper portions of the ribs 27*c* and 27*c* formed in the inner walls of the hood portion 22 are tapered so that it is easy to guide the connector body 24 to a suitable position. The other configuration in this modification is the same as that in the above-mentioned carrying-out mode.

As has been described, according to the present invention, an insertion guide rib formed in a connector body is inserted and fitted into a connector guide groove formed in a hood portion. Accordingly, there is an effect that it is possible to fit the connector body to the hood portion surely without tilting the connecting body. Accordingly, there is no fear that the connector body is tilted, and it is therefore possible to prevent terminals (wiring terminals) inside the connector from being injured. In addition, the insertion guide rib formed in the connector body has both a function to prevent a lever from shaking in any direction but the direction of rotation, and an insertion guide function to guide the connector body. Accordingly, there is an effect that it is possible to make the connector have a rational connector structure, and it is possible to minimize size of the connector as a whole.

As has been described, according to the present invention, the lever walls can be prevented by the inner wall of the hood portion from being bent when the lever is operated to rotate. Accordingly, the lever walls can be prevented from being detached from support portions of side walls of the connector body.

What is claimed is:

1. A lever fitting connector comprising:

a female connector portion having a hood portion for receiving terminals;

a male connector portion having a connector body portion for receiving mating terminals to be connected to said receiving terminals, said connector body portion being fitted within said hood portion;

a lever, rotatably attached to said male connector, for inserting and fitting said connector body portion into said hood portion;

a protrusion portion, formed on one side of said lever, for locking with said hood portion;

an operation portion, formed on the other side of said lever, for performing a rotating operation;

an insertion guide rib formed on said connector body portion and inserted into a connector guide groove formed in said hood portion, and a long guide hole formed in said insertion guide rib receives said protrusion portion so that said protrusion portion engages with a notch portion of said hood portion, when said connector body portion is fitted into said hood portion said notch portion acts as pivot points around which said lever pivots so as to force said male connector and said female connector into mating engagement.

2. A lever fitting connector according to claim 1, wherein said lever has two lever walls which are rotatably and slidably in contact with opposite side walls of said connector body portion, said protrusion portion is formed on one side of each of said lever walls, said operation portion connecting said lever walls are formed on the other side, said lever walls are sandwiched between said side walls of said connector body portion and the inner wall of said hood portion in a condition that said connector body portion is fitted into said hood portion.

* * * * *